US009491560B2

(12) United States Patent
Adams

(10) Patent No.: US 9,491,560 B2
(45) Date of Patent: Nov. 8, 2016

(54) SYSTEM AND METHOD FOR IMPROVING HEADPHONE SPATIAL IMPRESSION

(75) Inventor: Robert Adams, Acton, MA (US)

(73) Assignee: Analog Devices, Inc., Norwood, MA (US)

( * ) Notice: Subject to any disclaimer, the term of this patent is extended or adjusted under 35 U.S.C. 154(b) by 1114 days.

(21) Appl. No.: 13/115,550

(22) Filed: May 25, 2011

(65) Prior Publication Data

US 2012/0020502 A1 Jan. 26, 2012

Related U.S. Application Data

(60) Provisional application No. 61/365,940, filed on Jul. 20, 2010.

(51) Int. Cl.
*H04R 5/02* (2006.01)
*H04S 7/00* (2006.01)

(52) U.S. Cl.
CPC ..... *H04S 7/304* (2013.01); *H04S 2420/01* (2013.01)

(58) Field of Classification Search
CPC .... H04S 7/304; H04S 7/303; H04S 2420/01; G06F 3/012; H04R 5/033; H04R 5/04
USPC ..... 381/310
See application file for complete search history.

(56) References Cited

U.S. PATENT DOCUMENTS 5,645,077 A * 7/1997 Foxlin ..... 600/587
5,696,831 A * 12/1997 Inanaga et al. ..... 381/309
5,742,264 A * 4/1998 Inagaki et al. ..... 345/8
6,184,847 B1 * 2/2001 Fateh ..... G06F 3/011 345/8
6,532,291 B1 * 3/2003 McGrath ..... 381/74
6,937,272 B1 * 8/2005 Dance ..... 348/208.2
6,947,569 B2 * 9/2005 Yamada et al. ..... 381/310
6,970,569 B1 * 11/2005 Yamada ..... 381/310
8,422,693 B1 * 4/2013 Daily et al. ..... 381/86
2005/0256675 A1 11/2005 Kurata
2006/0198527 A1 * 9/2006 Chun ..... 381/17
2008/0273708 A1 * 11/2008 Sandgren et al. ..... 381/63
2011/0293129 A1 * 12/2011 Dillen et al. ..... 381/370

OTHER PUBLICATIONS

Wenzel et al., "Sound Lab: A Real-Time, Software-Based System for the Study of Spatial Hearing", Feb. 2000, AES, 108th Convention, pp. 1-28.*

(Continued)

*Primary Examiner* — Davetta W Goins
*Assistant Examiner* — Daniel Sellers
(74) *Attorney, Agent, or Firm* — Schwegman Lundberg & Woessner, P.A.

(57) ABSTRACT

A headphone system includes a headphone, a sensor, and a processor. The headphone may provide sound from virtual speakers to a listener via a plurality of sound paths that are filtered with a plurality of filters. The sensor may sense an angular velocity of a movement of the listener. The processor may receive the angular velocity and may calculate delays in the plurality of sound paths and filter coefficients for the plurality of filters based on the angular velocity, and insert the calculated delays in the plurality of sound paths and adjust the plurality of filters with the calculated filter coefficients.

26 Claims, 8 Drawing Sheets

(56) References Cited

OTHER PUBLICATIONS

Asahi et al., "Headphone Hearing system to reproduce natural sound localization", Trio-Kenwood Corporation, Meguro, Tokyo, 153. AES preprint # 1473, presented at the 63rd convention, May 1979.

Agazi et al., 2008, "Effective Use of Psychoacoustics in Motion-Tracked Binaural Audio", Tenth IEEE International Symposium on Multimedia, pp. 562-567.

* cited by examiner

SYSTEM AND METHOD FOR IMPROVING HEADPHONE SPATIAL IMPRESSION

CROSS-REFERENCE TO RELATED APPLICATIONS

This application claims priority from U.S. Provisional Patent Application No. 61/365,940, filed on Jul. 20, 2010, which is incorporated herein in its entirety.

FIELD OF THE INVENTION

The present invention is generally directed to a device and method for rendering spatial audio. In particular, the present invention is directed to a headphone having a sensor to detect the head position and use the head position information to reduce "in-head" localization of the perceived sound.

BACKGROUND INFORMATION

A known problem associated with listening with headphones is the so called "in-head" localization phenomenon. The "in-head" localization may create a sound image inside the listener's head, which, when the listener moves his head, moves with and stays inside the listener's head rather than staying at a perceived external location. The "in-head" localization may create undesirable and un-natural sound perception to the listener.

Previously, various digital signal processing techniques have been used to trick human brains to "think" that the sound source is from the outside of the listener's head and thus improves the perceptual quality of headphone sound. Some of these systems attempted to measure the angle of the listener's head with respect to virtual speakers based on the measured head angle to reduce the effect of "in-head" localization. However, these existing systems require the listener to be tethered through a physical connection to a central system and thus prevent the listener from moving freely.

Therefore, there is a need for a headphone system and sound rendering method that may enable a listener to roam freely without being tethered while solving the problem of "in-head" localization.

DETAILED DESCRIPTION OF EXAMPLE EMBODIMENTS

Figure 1:
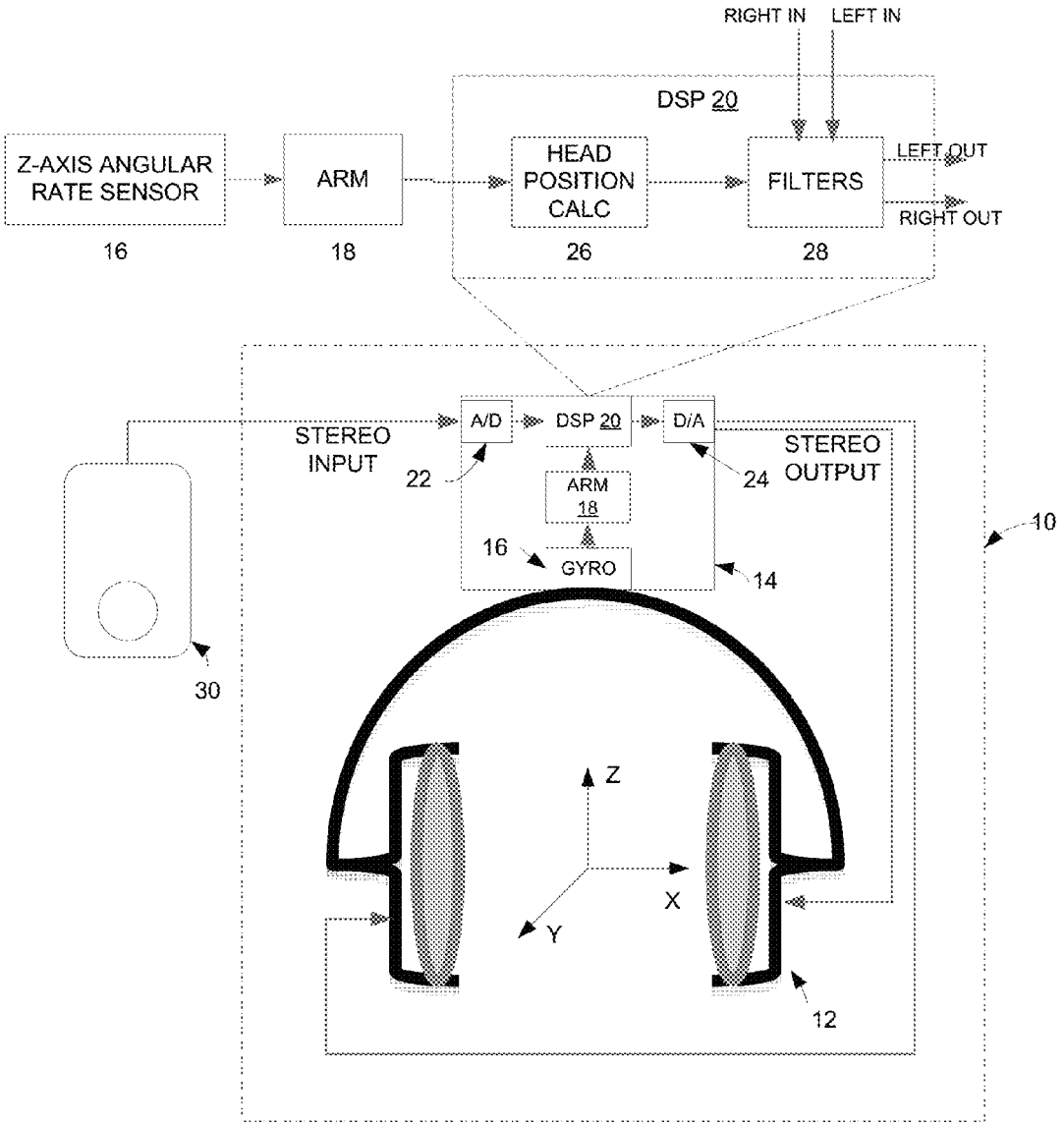
FIG. 1 illustrates a headphone system according to an exemplary embodiment of the present invention.

Embodiments of the present invention may include a headphone system that includes a headphone, a sensor, and a processor. The headphone may provide sound from virtual speakers to a listener via a plurality of sound paths that are filtered with a plurality of filters. The sensor may sense an angular velocity of a movement of the listener. The processor may receive the angular velocity and may calculate delays in the plurality of sound paths and filter coefficients for the plurality of filters based on the angular velocity, and insert the calculated delays in the plurality of sound paths and adjust the plurality of filters with the calculated filter coefficients.

Embodiments of the present invention may include a method for rendering sound to a listener from virtual speakers to a listener via a plurality of sound paths that are filtered with a plurality of filters. The method may include steps of receiving an angular velocity of a movement of the listener sensed by a sensor, calculating delays in the plurality of sound paths and filter coefficients for the plurality of filters based on the angular velocity, and inserting, by the processor, the calculated delays in the plurality of sound paths and adjusting, by the processor, the plurality of filters with the calculated coefficients.

Humans perceive the location of a sound source based on different sound arrival times and spectra between left and right ears. A headphone system may virtually create realistic sound effects by inserting delays and filters based on angles of sound paths from sound sources to the left and right ears. The sound path from a sound source to each ear may be modeled according to an angle-dependent frequency response and an angle-dependent delay. The angle-dependent frequency responses are commonly known as head-related transfer functions ("HRTFs"). Each person may have a unique set of HRTFs depending on the shapes of the person's head and outer ears. In practice, the HRTFs that are used to render sound to the ears may come from existing databases rather than from an actual measurement on the person's head. Thus, the HRTFs used may be different from the true HRTFs of the listener. If the HRTFs used to render the sound do not match the true HRTFs of the listener, the spatial effect of the sound may be weakened.

Further, in practice, to enhance the spatial effect, the headphone system may add some spatial reverberations to improve the perceived "out-of-head" sound source experience. For example, a headphone system may create a virtual left main speaker and a virtual right main speaker. In addition, the headphone system may create two virtual left reflection speakers and two virtual right reflection speakers for a total of six speakers. Each virtual speaker may have a first angle-dependent sound path to the right ear and a second angle-dependent sound path to the left ear. Thus, for the six virtual speakers, a total of twelve sound paths may need to be calculated. Each of these sound paths may have a unique angle to the head position and may be represented by an angle-dependent digital filter with an angle-dependent delay. Thus, sensing the head position of the listener (or the angles from the listener's head to virtual speakers) using an angle sensing device such as a gyroscope attached to the headphone and modifying delays of sound paths according to head position changes may help create a more realistic spatial sound effect to the listener.

A gyroscope is a device that may detect angular velocity (or a rate of angular changes) of an object. Recent developments in microelectromechanical systems (MEMS) have made it possible to manufacture small-scale and portable MEMS-based gyroscopes that, when placed on a human head, may detect a rate of head rotations or a rate of head angles from a nominal 0-degree position. This head rotation information may be used to generate sound effects that may have less "in-head" localization.

The gyroscope commonly measures a quantity that is proportional to an angular velocity rather than an absolute angular position. Angular positions of the listener's head may be obtained by integrating the output angular velocity from the gyroscope over time. One problem with the integration is that any DC offset in the gyroscope output also may be integrated over time and create a gradual drift from the nominal 0-degree position of the listen's head. This drift may cause undesirable side effects.

FIG. 1 illustrates a headphone system according to an exemplary embodiment of the present invention. A listener may listen to audio from an audio player 30 through a headphone system 10. The headphone system 10 may include a headphone 12 and an audio processing device 14 mounted on and coupled to the headphone 12. The audio processing device 14 may further include a gyroscope 16 for measuring an angular velocity of the head, an ARM processor 18 coupled to the gyroscope 16 for converting the data output of the gyroscope 16 into a digital format, a digital signal processor (DSP) 20 coupled to the ARM processor 16 for computing the angular position of the head and perform filtering on sound inputs. The audio processor 14 also may include an analog-to-digital converter (A/D) 22 for converting analog sound input into a digital format that is suitable for processing at the DSP 20 and a digital-to-analog converter (D/A) 24 for converting a digital sound signal from the DSP into an analog sound output that is suitable for the headphone 12. The DSP 20 may be configured with different functionalities for sound signal processing. For example, the DSP may be configured with a head position calculator 26 for computing the head position with respect to a reference and filters 28 for inserting delays and performing filter operations on the digitized sound signals. The coefficients of the filters 28 may be adjusted based on the calculated head positions.

In operation, the headphone may be positioned within a coordinate system with X, Y, and Z axes as shown in FIG. 1. The headphone may render audio from a number of virtual speakers whose positions are situated in accordance to the coordinate system. Each virtual speaker may have a first sound path to the left ear and a second sound path to the right ear. The gyroscope 16 may continuously measure an angular velocity (or angular rate) with respect to the Z axis and output data in Serial Peripheral Interface (SPI) format to the ARM processor 18. The ARM processor 18 may convert SPI format to a data format appropriate for the DSP and also may load program boot codes for the DSP 20. The DSP 20 may receive real-time angular velocity from the ARM 18, compute angular positions of the head by integration, then compute interpolated filter coefficients, and then execute the digital filters. The integration may be carried out in a way that the DC gains are reduced at low frequency range. The DSP 20 may further compute updated sound paths from the virtual speakers based on the angular positions of the listener's head. The filter 20 may perform filtering operations on the stereo sound input from the audio player 30. Additionally, the coefficients of the filters 28 may be adjusted based on the updated sound paths. These adjustments of filter coefficients may change filter frequency responses and delays inserted in sound paths and produce the realistic effect of moving sound sources.

Figure 2:
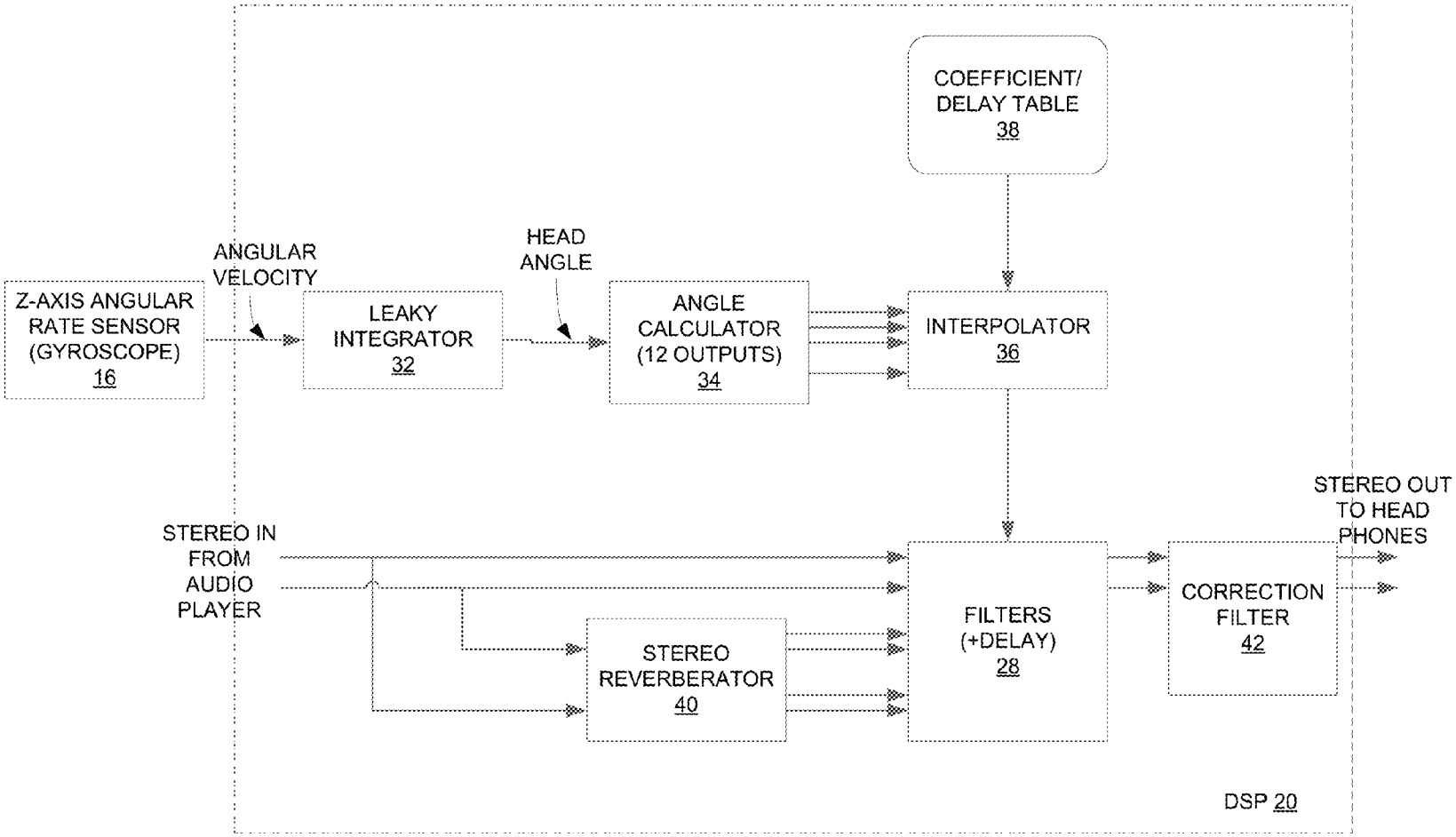
FIG. 2 illustrates a system that reduces "in-head" localization effect of a headphone according to an exemplary embodiment of the present invention.

FIG. 2 illustrates a system that reduces "in-head" localization effect of a headphone according to an exemplary embodiment of the present invention. The system may include a gyroscope 16 for sensing angular velocity with respect to a Z-axis and a DSP 20 for calculating the head position and filter coefficients derived from the head position. The DSP 20 may be configured with a stereo reverberator 40 for generating reverberating sound paths, filters 28 for providing proper frequency responses and delays to each sound path, and a correction filter 42 for compensating the non-ideal response of the headphone 12. The DSP 20 may be further configured with a leaky integrator 32 for calculating the head position from the angular velocity, an angle calculator 34 for calculating the angles of the virtual speakers with respect to the head position, and an interpolator 36 for interpolating coefficients for filters 28 based on fixed coefficient values stored in coefficient/delay table 38. The leaky integrator, compared to a regular integrator, may have the advantage of less DC drifting.

In operation, an audio player may generate multiple sound paths (via a stereo reverberator) to the filters 28. The filters 28 may insert proper frequency responses and delays to the multiple sound paths and render a realistic sound scene to a listener who wears the headphone 12 with a gyroscope 16. When the listener rotates his head around the Z-axis, the gyroscope 16 mounted on the headphone may sense and output an angular velocity of the head rotation. The leaky integrator 32 may integrate the angular velocity to obtain the head position in terms of a rotational angle from the 0-degree nominal position. As discussed before, a regular integrator may have the drifting problem. Therefore, the leaky integrator may be designed to reduce DC gains at low frequency ranges to overcome the drifting problem. The angle calculator 34 may further calculate angles of sound paths from the virtual speakers to the new head position. When there are six virtual speakers, a total of 12 angles of sound paths may need to be calculated for both the left and right ears with respect to the head rotation. Based on the updated angles of sound paths from the virtual speakers, the interpolator 36 may compute new filter coefficients for the filters 28 by interpolations. For example, the coefficient/delay table may include coefficients for a $6^{th}$-order filter from −180 to 175 degrees with 5 degree increments of head rotation. Given an angle for a sound path, the interpolator 36 may interpolate the coefficients for the angle of the sound path based on the values given in the coefficient/delay table 38. The interpolated coefficients may then be used to update the 12 $6^{th}$-order filters to generate delays and filters with interpolated frequency responses in the sound paths. Thus, the interpolator 36 may produce a smooth transition of sound scenes from one head position to the next.

The correction filter 42 may be coupled to filters 28 and be used as a static angle-independent headphone-correction filter that compensates for the non-ideal frequency response of the headphone. The correction filter 42 may increase the sense of realism by matching the frequency response of actual external speakers to the frequency response of the combination of the headphone and virtual speakers.

Figure 3A:
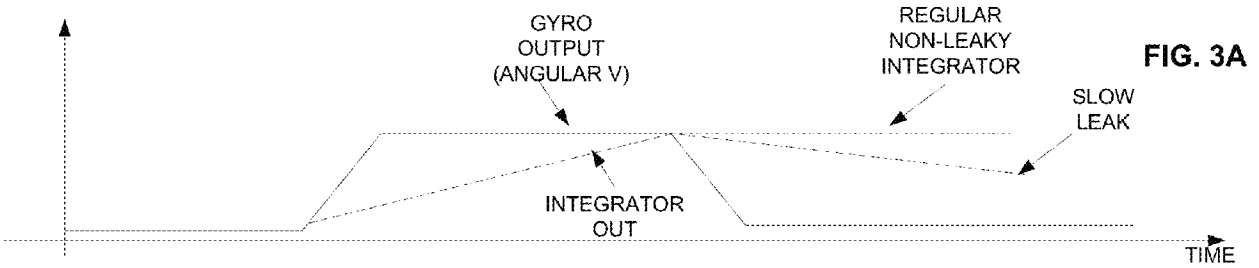
FIGS. 3A-3C illustrate leaky integrations according to exemplary embodiments of the present invention.
Figure 3B:
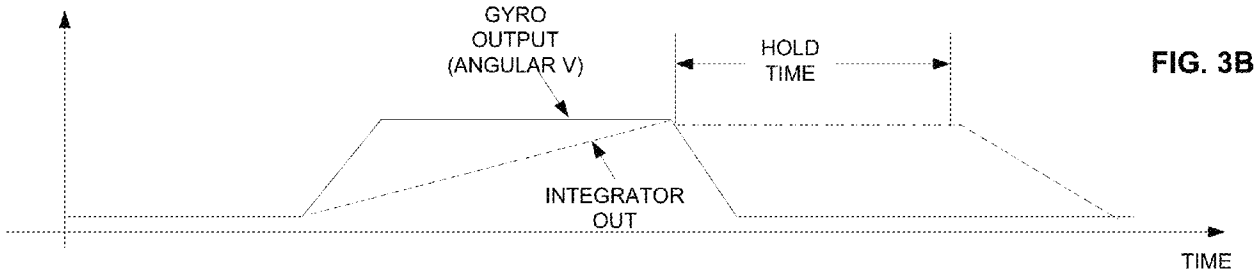
Figure 3C:
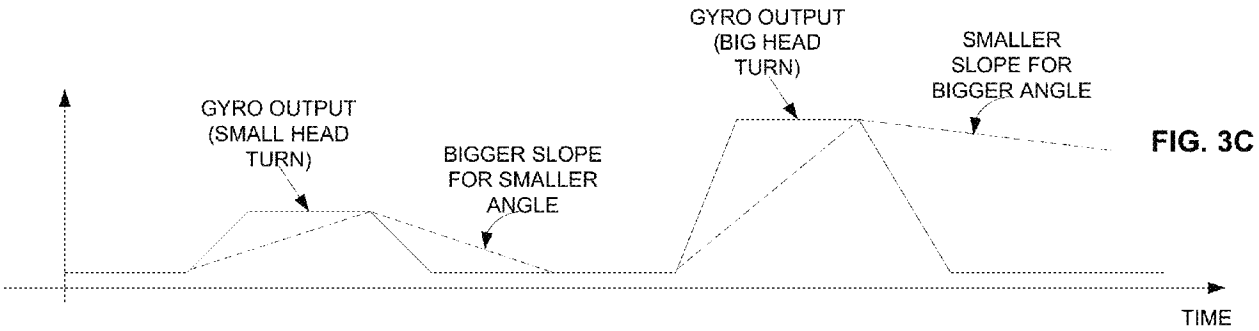

FIGS. 3A-3C illustrate leaky integrations according to exemplary embodiments of the present invention. FIG. 3A illustrates a leaky integration as compared to a non-leaky regular integration. When the listener turns his head and holds that position for a period of time, an output of the gyroscope may exhibit a bump of angular velocity indicating an initial increase, a steady period during the head turn, and eventual decrease of angular velocity at the end of the head turn. A non-leaky regular integrator may integrate the angular velocity. After the head turn, the output of a regular integrator may have stayed at a substantially constant value. An output of a leaky integrator may instead slowly drift toward the nominal 0-degree position. Thus, the images of the virtual speakers also may drift back toward their nominal positions. In one embodiment of the present invention, the drift may take from 5 seconds to 5 minutes, and the drift may be at a constant rate along a slope.

FIG. 3B illustrates the characteristics of another leaky integrator according to an exemplary embodiment of the present invention. In this embodiment, a timeout counter may be used to count a hold time after the listener has turned his head. During the hold time, the integrator feedback weight may be set to 1.0, resulting in a leakage slope of 0. The counter may be triggered by a change in the output of the gyroscope greater than a predetermined threshold. Thus, the leaky integrator may drift toward 0-degree position only after the time counted by the timeout counter is greater than a predetermined threshold value or the hold time. This approach may have the advantage of allowing the listener to turn his head back within the prescribed hold time before drifting is apparent, since within the hold time, the listener may not perceive any image wandering.

FIG. 3C illustrates the characteristics of yet another leaky integrator according to an exemplary embodiment of the present invention. Human ears are most sensitive to static errors when the head is close to 0-degree position. To overcome this problem, in this embodiment, the leak may have a large leak factor (or a steeper slope of drifting back to the nominal 0 degree position) when the head rotation is small and/or near the 0-degree position, and have a small leak factor (or a shallower slope of drifting) when the head rotation is large/or away from the 0-degree position. In this way, the static offset-induced 0-degree angle error is reduced without causing a rapid image drift rate for large head turn angles.

Figure 4:
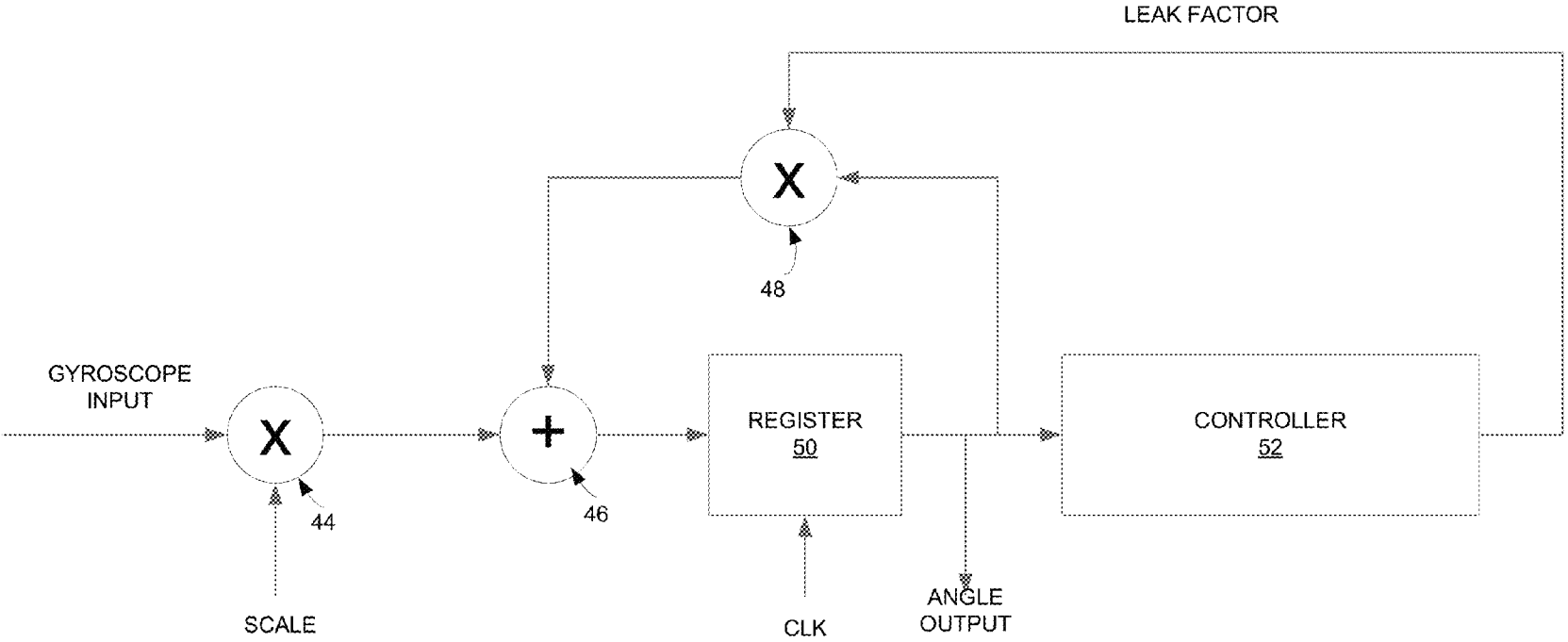
FIG. 4 illustrates a system that adaptively adjusts the leaky factor according to an exemplary embodiment of the present invention.

FIG. 4 illustrates a system that may adaptively adjust leaky factor according to an exemplary embodiment of the present invention. FIG. 4 illustrates an exemplary implementation of the leaky integrator that may adaptively adjust the amount of leak based on how many degrees the head turns. In this embodiment, the adaptive leaky integrator may include multipliers 36, 40, an adder 46, a register 50, and a controller 52 for calculating leak factor or for storing a leak factor lookup table. Thus, an angular velocity input from a gyroscope may first be multiplied by a scale factor at the multiplier 44. The adder 46 may have a first input of the scaled angular velocity and a second input from the multiplier 48. The output from the adder 46 may be fed into the register 50 with a variable feedback weight controlled by the "leak factor" through multiplier 48. When "leak Factor" is set to 1.0, the output of register 50 may represent an integrator without any leak. When "leak factor" is set to a value less than 1.0, the output of register 50 may slowly return to zero after the input is set to a value of zero over a period of time, thus representing a leaky integrator. The output of the register 50 may be an integration (or accumulation) of the input angular velocity. The integration may represent an angle output of the head turn. For an adaptive leaky integration, the angle output may also be fed into the controller 52. In one embodiment, the controller 52 may calculate a leak factor based on the value of the output angle. For example, as shown in FIG. 3C, the leak factor may be large when the output angle is small, and small when the output angle is large. In an alternative embodiment, the controller may include a lookup table so that the leak factor may be determined by looking up the table based on the output angle. The lookup table may encode linear or non-linear relations between an amount of head turns and the leak factor. The leak factor may be fed into the multiplier 48 where the output angle from register 50 may be multiplied by the leak factor for an adaptive leaky integration. The output from the multiplier 48 may be fed into the second input of the adder 46.

Figure 5:
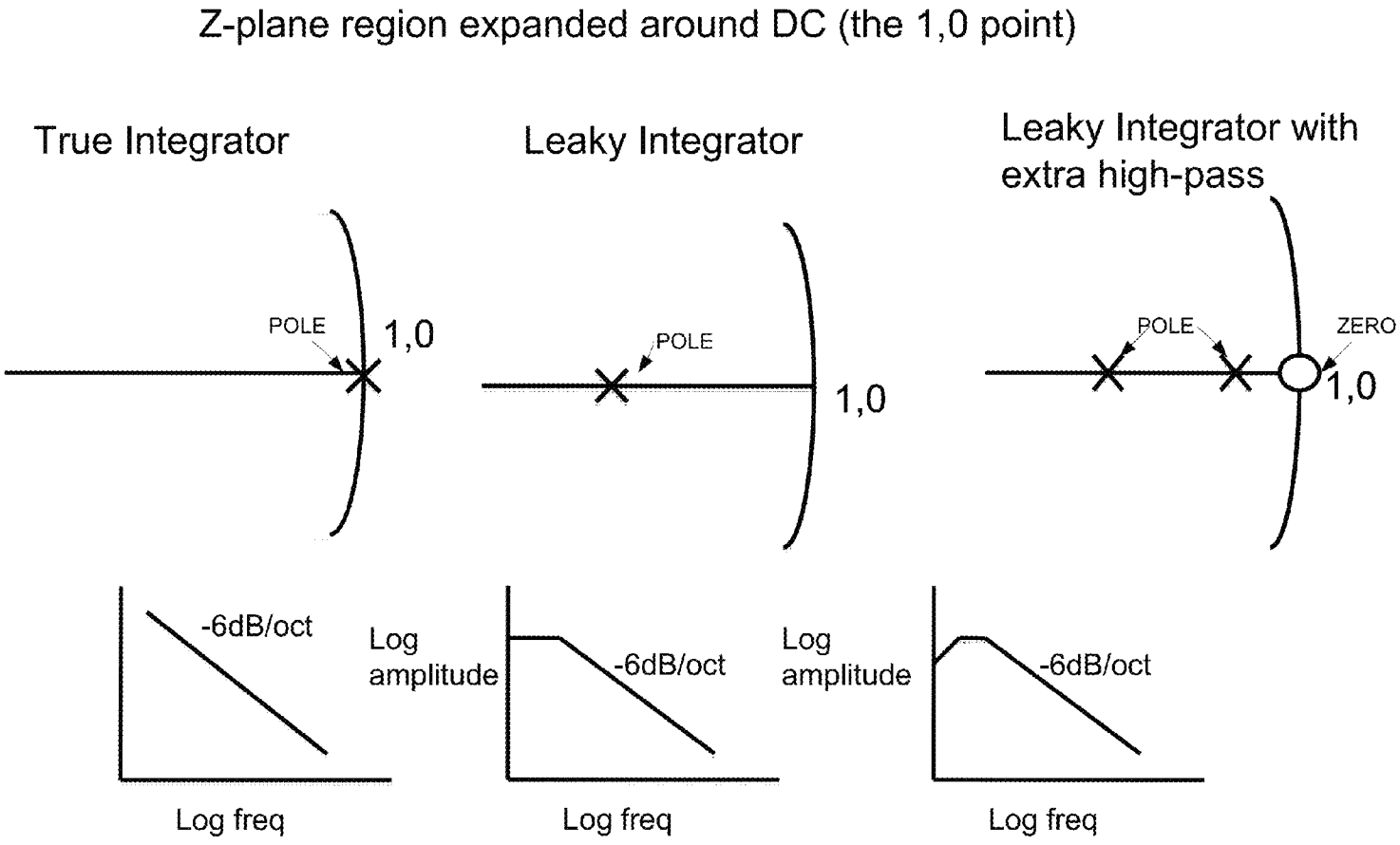
FIG. 5 illustrates frequency responses of a regular integrator, a leaky integrator and a leaky integrator with extra high-pass.

FIG. 5 illustrates frequency responses of a regular integrator, a leaky integrator and a leaky integrator with extra high-pass. FIG. 5 shows the z-plane of these different integrators. The regular true integrator may have a pole at (1, 0) on the z-plane. Its frequency response then may decline at a rate of −6 dB/octave on a log frequency scale. In contrast, a leaky integrator may have a pole shifted away from (1, 0) to the left. Thus, the frequency response of the leaky integrator may first be a plateau followed by the decline at −6 dB rate. Yet another leaky integrator with extra high-pass may have two poles and one zero on the z-plane. The combined effect of the two poles and the one zero may be first high-pass and then followed by the decline at −6 dB rate. The high-pass filter may reduce the static 0-degree image error caused by gyro DC offset.

Figure 6:
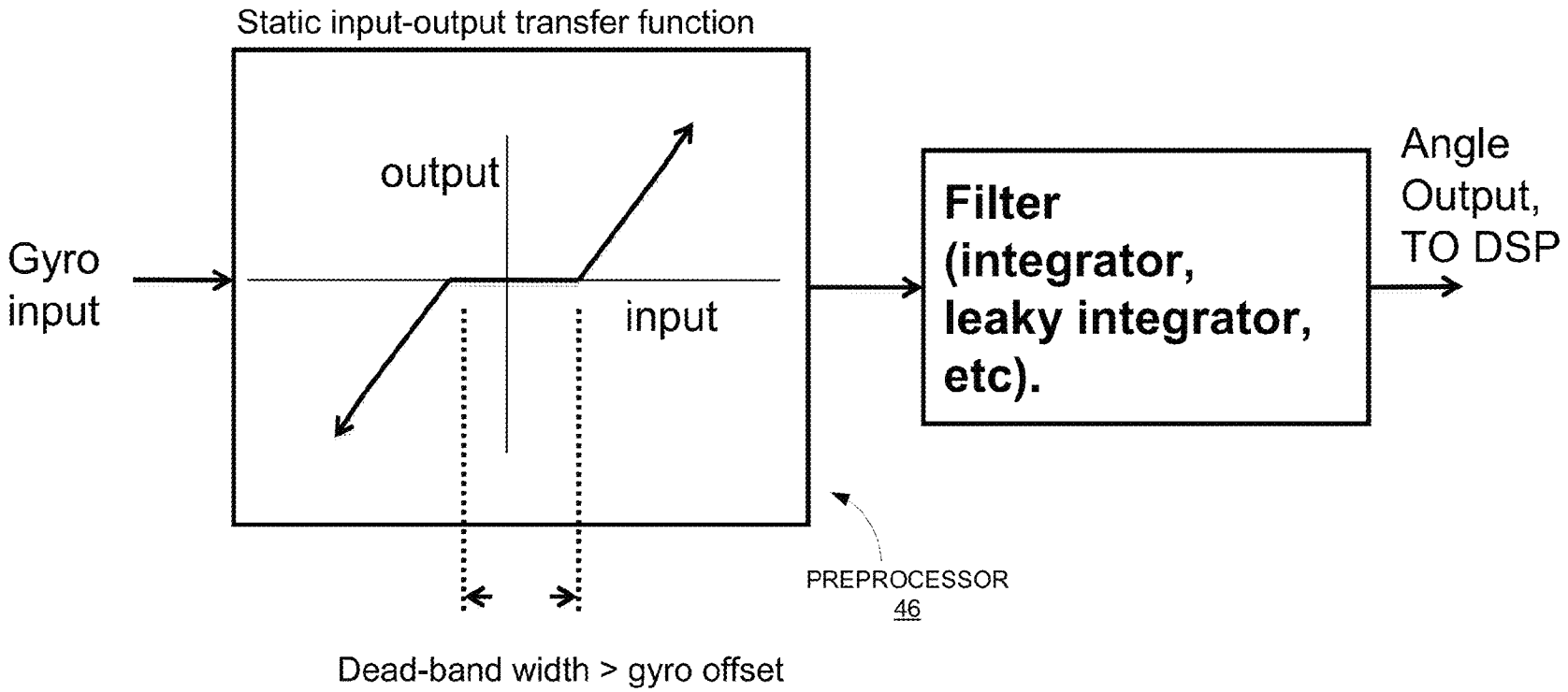
FIG. 6 illustrates a preprocessor to integrators according to an exemplary embodiment of the present invention.

FIG. 6 illustrates a preprocessor for subsequent integrators according to an exemplary embodiment of the present invention. A preprocessor 46 having an input/output transfer function as shown in FIG. 6 may be situated before an integrator (leaky or non-leaky) when a minimum head rotation rate that the listener could produce at the gyroscope output is well above a specified gyroscope DC offset. The preprocessor 46 may be characterized with a transfer function that, within a dead-band of the input, has no output. The width of the dead-band may be greater than the specified offset of the gyroscope. Outside the dead-band, the output of the gyroscope may respond to the input directly. The output of the preprocessor 46 may be provided to a leaky or non-leaky integrator. Thus, the offset of the gyroscope that falls within the dead-band of the preprocessor 46 may not affect the subsequent integration or cause an "image drift."

Figure 7:
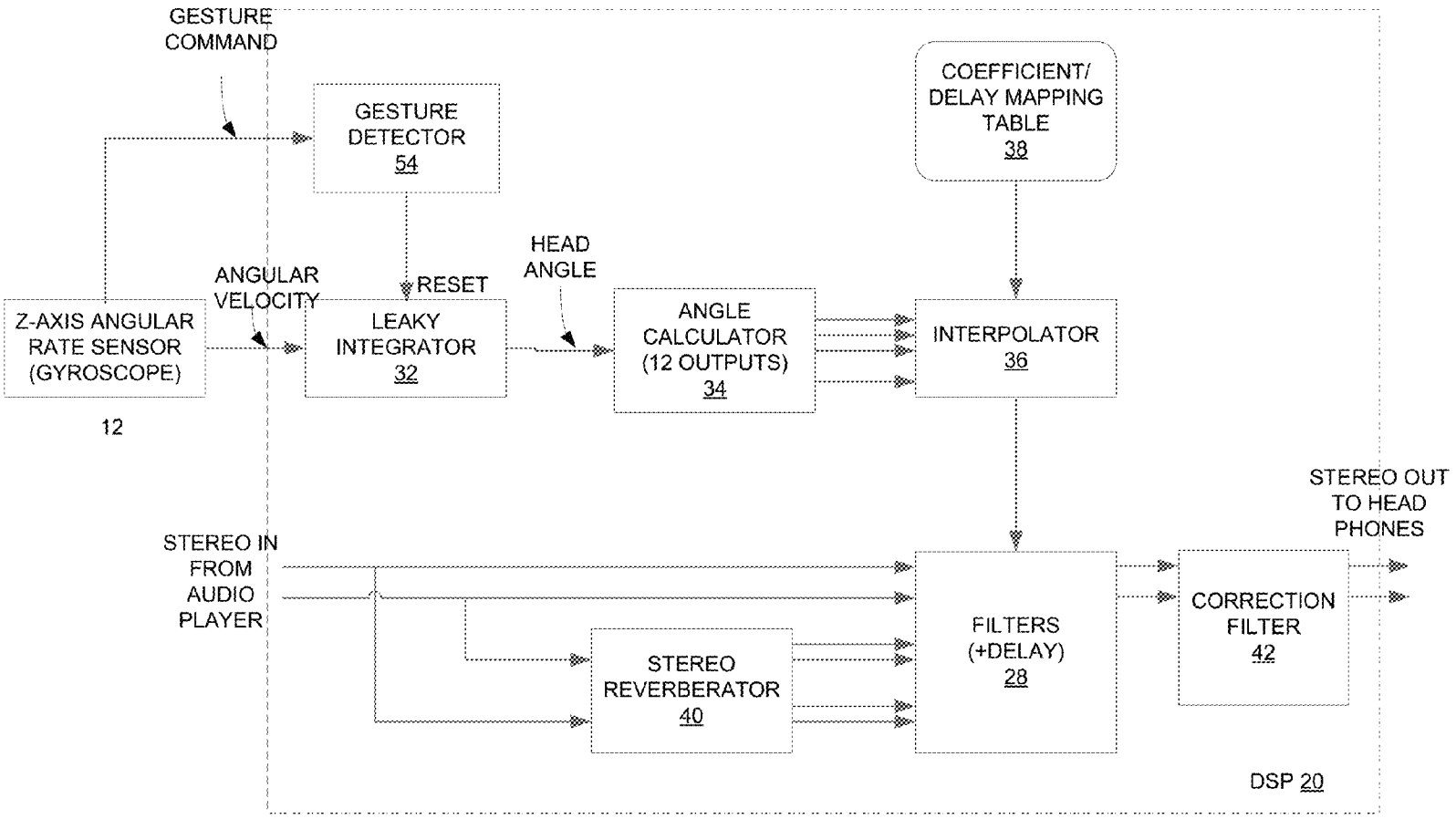
FIG. 7 illustrates a system that includes a gesture detector for controlling the spatial image of a headphone according to an exemplary embodiment of the present invention.

FIG. 7 illustrates a system that includes a gesture detector for reducing "in-head" localization effect of a headphone according to an exemplary embodiment of the present invention. Compared to FIG. 2, the system of this embodiment may include an additional gesture detector 54 coupled between the gyroscope 16 and the leaky integrator 32. In one embodiment, the gesture detector 54 may be a functionality that is configured on the DSP 20. Alternatively, the gesture detector 54 may be implemented in a hardware device that is separate from the DSP 20. The gesture detector 54 may detect a gesture command issued by the listener. The gesture command may be embedded as specific patterns in the gyroscope output. Based on the detected gesture command, the gesture detector 54 may change the behavior of the leaky integrator. In one exemplary embodiment of the present invention, when the listener has changed position and wishes to re-center the stereo image, the listener may issue a gesture command such as shaking his head left and right around the Z-axis. The head shake may generate a signal similar to a sinusoid in the gyroscope output. The gesture detector 54 may include a band-pass filter that may detect sinusoid signals at certain frequency. When the output from the band-pass filter is greater than a predetermined threshold, the gesture detector 54 may issue a reset signal to the leaky integrator to reset the integration. In this way, the listener may actively control and reset the positions of these virtual speakers to the nominal 0-degree position. Alternatively, a given command pattern may be decoded by software designed to find given patterns in the gyroscope output over time. For example, by looking for alternating polarities of rotational velocity that exceed a given threshold within a given time period, command information may be decoded. Such command gestures may be designed such that normal head movements do not result in a "false command trigger".

Figure 8:
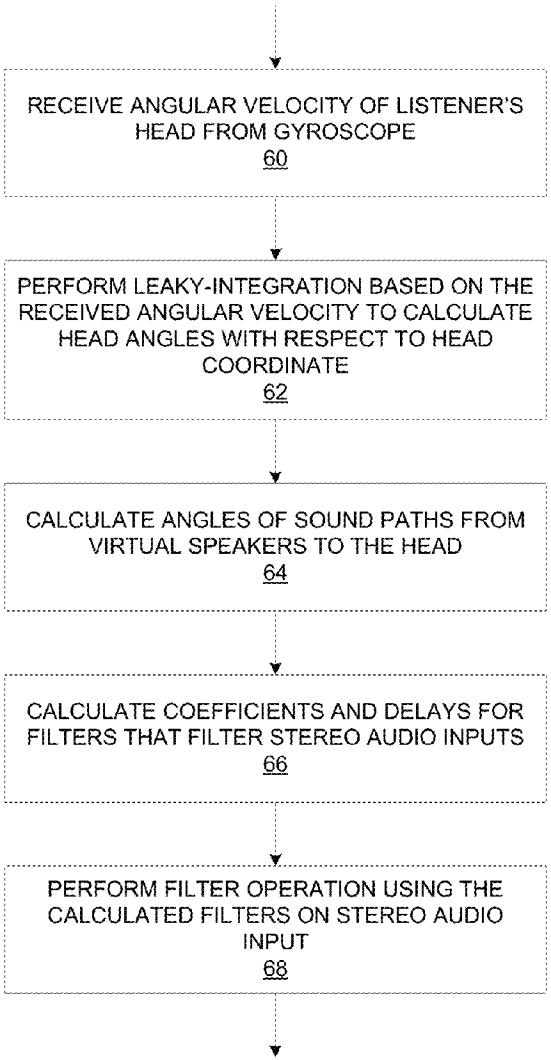
FIG. 8 illustrates a method for reducing "in-head" localization effect of a headphone according to an exemplary embodiment of the present invention.

Embodiments of the present invention may include methods for using gyroscopes to reduce "in-head" localization in headphones. FIG. 8 illustrates a method for reducing "in-head" localization effect of a headphone according to an exemplary embodiment of the present invention. At 60, a processor such as DSP 20 of FIG. 1 may receive an angular velocity sensed by a gyroscope 16 mounted on a headphone 12. In response to receiving the angular velocity, at 62, the processor may perform a leaky integration on the received angular velocity to calculate the head position in terms of a rotational angle with respect to a reference position. The leaky integration as discussed above may have the advantage of less drifting over a regular integration. Based on the head position, at 64, the processor may calculate angles of incidence for sound paths from virtual speakers to the listener's left and right ears. Thus, a six speaker system may have twelve sound paths. Based on the angles of incidence, coefficients of filter 28 may be calculated and adjusted to generate appropriate delays and frequency responses. At 68, the calculated filter may be applied to the stereo sound input to produce a sound output to the listener that has less "in-head" localization.

Although the present invention is discussed in terms of a single-axis gyroscope, the invention may readily be extended to 2- or 3-axis gyroscopes. A 2-axis gyroscope may detect an additional angle in the vertical direction such as when the listener looks up and down. A 3-axis gyroscope may detect a further additional angle of the head tilting sideways. The positions of the virtual speakers may remain the same. However, the computation of angles of sound paths to left and right ears may take into account the additional head rotation information with respect to 2- or 3-axis.

Although the present invention is discussed in view of the head movement of a listener, the principles of the present invention may be readily applied to other types of movements of the listener sensed by an angular velocity sensor such as a gyroscope. For example, the angular velocity sensor may be embedded in a handheld device such as a tablet PC or a smart phone. Further, the angular velocity sensor may be associated with and activated by an application of the handheld device. An exemplary application may include a racecar game that uses the handheld device as the driving wheel and outputs sound effects via a headphone. Thus, when a user plays the racecar game while listening to sound effects through the headphone, the sensed angular velocity of the handheld device may be supplied to exemplary embodiments of the present invention (e.g., as shown in FIG. 2), in place of the head movement of the listener, to enhance the sound effects through the headphone as described in the embodiments of the present invention.

Those skilled in the art may appreciate from the foregoing description that the present invention may be implemented in a variety of forms, and that the various embodiments may be implemented alone or in combination. Therefore, while the embodiments of the present invention have been described in connection with particular examples thereof, the true scope of the embodiments and/or methods of the present invention should not be so limited since other modifications will become apparent to the skilled practitioner upon a study of the drawings, and specification.

What is claimed is:

1. A headphone system, comprising:

a headphone for providing sound from virtual speakers to a listener via a plurality of sound paths that are filtered with a plurality of filters;

a sensor for sensing a head movement of the listener; and a processor for receiving information about the sensed head movement, wherein the processor is configured to:

based on the information about the sensed head movement, determine a head position of the listener with respect to a reference position, based on the determined head position, apply first delays in the plurality of sound paths for a hold time and/or apply first filter coefficients for the plurality of filters for the hold time, the hold time selected based on the information about the sensed head movement, and following the selected hold time, apply other delays in the plurality of sound paths and/or apply other filter coefficients for the plurality of filters, the other delays and other filter coefficients based on a head position that drifts toward the reference position.

2. The headphone system of claim 1, wherein the sensor includes a gyroscope.

3. The headphone system of claim 1, wherein the sensor senses an angular velocity of the head movement of the listener, and wherein the information about the sensed head movement includes angular velocity information.

4. The headphone system of claim 3, wherein the processor is further configured to determine the head position of the listener by performing a leaky integration of the angular velocity to generate an output corresponding to a current head position.

5. The headphone system of claim 4, wherein the output of the leaky integration drifts toward the reference position after the head movement to reposition the listener's head with respect to the virtual speakers.

6. The headphone system of claim 4, wherein the output of the leaky integration holds an integrated value substantially constant for the hold time after the head movement and thereafter drifts toward the reference position to reposition the listener's head with respect to the virtual speakers.

7. The headphone system of claim 4, wherein the leaky integration has a larger leak factor if a head rotation is small and a smaller leak factor if the head rotation is large.

8. The headphone system of claim 4, wherein the processor is configured to perform a non-linear transformation prior to the leaky integration, and wherein the non-linear transformation includes a dead-band that is wider than an offset of the sensor.

9. The headphone system of claim 4, further comprising a gesture detector for detecting a head gesture which triggers a reset of the leaky integration.

10. The headphone system of claim 9, wherein the head gesture is a shake of the listener's head.

11. The headphone system of claim 4, wherein (i) the leaky integration has a leak factor dependent on the head movement and (ii) the output of the leaky integration drifts back to the reference position in accordance with the leak factor after the hold time exceeds a predetermined time.

12. The headphone system of claim 1, further comprising:

a counter for counting the hold time after the sensed head movement.

13. The headphone system of claim 1, wherein the processor is further configured to calculate angles of incidence for the plurality of sound paths to ears of the listeners, and wherein the processor is configured to calculate the first delays and/or the first filter coefficients based on the calculated angles of incidence.

14. The headphone system of claim 1, wherein the processor circuit is configured to apply the first delays in the plurality of sounds paths for the hold time and apply the first filter coefficients for the plurality of filters for the hold time, and wherein the processor circuit is configured to apply the other delays in the plurality of sound paths and apply the other filter coefficients for the plurality of filters following the selected hold time.

15. A method for rendering sound from virtual speakers to a listener via a plurality of sound paths that are filtered with a plurality of filters, the method comprising:

receiving, by a processor, information about a head movement of the listener, the information sensed by a sensor;

based on the received information about the head movement of the listener, determining a head position of the listener with respect to a reference position;

based on the determined head position, applying first delays in the plurality of sound paths for a hold time and/or applying first filter coefficients for the plurality of filters for the hold time, the hold time selected based on the information about the head movement; and following the selected hold time, applying other delays in the plurality of sound paths and/or applying other filter coefficients for the plurality of filters, the other delays and other filter coefficients based on a head position that drifts toward the reference position.

16. The method of claim 15, wherein the sensor includes a gyroscope.

17. The method of claim 15, further comprising:

counting, with a counter, the hold time after the head movement.

18. The method of claim 15, further comprising:

drifting the output of the leaky integration back to the reference position in accordance with a leak factor of the leaky integration after the hold time exceeds a predetermined time, wherein the leak factor is dependent on the head movement.

19. The method of claim 15, wherein the receiving the information about a head movement of the listener includes receiving angular velocity information about the head movement of the listener.

20. The method of claim 19, further comprising performing a leaky integration to generate an output corresponding to a current head position of the listener with respect to the reference position.

21. The method of claim 20, wherein the output of the leaky integration drifts toward the reference position after the head movement to reposition the listener's head with respect to the virtual speakers.

22. The method of claim 20, wherein the output of the leaky integration holds an integrated value substantially constant for a predetermined time after the head movement and thereafter drift toward the reference position to reposition the listener's head with respect to the virtual speakers.

23. The method of claim 20, wherein the leaky integration has a larger leak factor if a head rotation is small and a smaller leak factor if the head rotation is large.

24. The method of claim 20, further comprising: performing a non-linear transformation prior to the leaky integration, wherein the non-linear transformation includes a deadband that is wider than an offset of the sensor.

25. The method of claim 20, further comprising: detecting a head gesture which triggers a reset of the leaky integration.

26. The method of claim 15, further comprising calculating angles of incidence for the plurality of sound paths to ears of the listener, wherein the applying the first delays and/or first filter coefficients includes based on the calculated angles of incidence.

* * * * *